US007263732B2

(12) United States Patent
Zheng

(10) Patent No.: US 7,263,732 B2
(45) Date of Patent: Sep. 4, 2007

(54) COLLAPSIBLE ASSEMBLY

(75) Inventor: Yu Zheng, Covina, CA (US)

(73) Assignee: Patent Category Corp., Walnut, CA (US)

( * ) Notice: Subject to any disclaimer, the term of this patent is extended or adjusted under 35 U.S.C. 154(b) by 49 days.

(21) Appl. No.: 10/448,553

(22) Filed: May 30, 2003

(65) Prior Publication Data

US 2003/0196266 A1 Oct. 23, 2003

Related U.S. Application Data

(63) Continuation of application No. 10/174,876, filed on Jun. 18, 2002, now Pat. No. 6,571,410, which is a continuation of application No. 09/553,651, filed on Apr. 21, 2000, now Pat. No. 6,408,461, which is a continuation of application No. 09/121,632, filed on Jul. 23, 1998, now Pat. No. 6,073,283.

(51) Int. Cl.
*A47G 9/06* (2006.01)

(52) U.S. Cl. ..... 5/417; 5/420

(58) Field of Classification Search ..... 5/417–420, 5/485, 486, 490, 502, 97, 414; 160/370.21; 135/150, 143, 138, 139, 119, 125, 95, 126, 135/128, 117; 296/97.7
See application file for complete search history.

(56) References Cited

U.S. PATENT DOCUMENTS 1,217,932 A * 3/1917 Fitzgerald ..... 160/377
2,870,464 A * 1/1959 Lalick ..... 5/484
3,801,420 A * 4/1974 Anderson ..... 428/102
4,951,333 A * 8/1990 Kaiser et al. ..... 5/417
5,024,262 A * 6/1991 Huang ..... 160/370.21
5,056,172 A 10/1991 Kaiser et al.
5,059,463 A * 10/1991 Peters ..... 428/64.1
5,116,273 A * 5/1992 Chan ..... 160/370.21
5,261,846 A * 11/1993 Hanna ..... 446/46
5,358,440 A 10/1994 Zheng
5,490,806 A * 2/1996 Spector ..... 446/48
5,553,908 A * 9/1996 Shink ..... 296/97.8
5,560,385 A 10/1996 Zheng
5,642,538 A * 7/1997 McAllister ..... 5/99.1
5,693,398 A 12/1997 Granger
6,073,283 A * 6/2000 Zheng ..... 5/417
6,170,100 B1 1/2001 Le Gette et al.
6,408,461 B2 * 6/2002 Zheng ..... 5/417
6,571,410 B2 * 6/2003 Zheng ..... 5/417

* cited by examiner

*Primary Examiner*—Michael Trettel
(74) *Attorney, Agent, or Firm*—Raymond Sun

(57) ABSTRACT

A blanket or mat assembly includes a panel having a foldable frame member that has a folded and an unfolded orientation, and a sheet material substantially covering the frame member when the frame member is in the unfolded orientation, with the sheet material assuming the unfolded orientation of its associated frame member. The assembly further includes a covering having a top portion, a peripheral edge, an opening defined by the peripheral edge, and an interior, with the panel retained inside the interior and accessing the interior of the covering via the opening. The covering assumes the configuration of the panel when the panel is retained inside the interior of the covering. The covering and the panel can be twisted and folded to the folded orientation of the frame member to reduce the overall size of the covering and the panel.

7 Claims, 7 Drawing Sheets

COLLAPSIBLE ASSEMBLY

RELATED APPLICATIONS

The present application is a continuation of Ser. No. 10/174,876, filed Jul. 18, 2002, now U.S. Pat. No. 6,571,410, for which is a continuation of Ser. No. 09/553,651, filed Apr. 21, 2000, now U.S. Pat. No. 6,408,461, which is a continuation of Ser. No. 09/121,632, filed Jul. 23, 1998, now U.S. Pat. No. 6,073,283, whose disclosures are incorporated by this reference as though set forth fully herein.

BACKGROUND OF THE INVENTION

1. Field of the Invention

The present invention relates to collapsible structures, and in particular to a collapsible blanket or mat assembly which offers multiple uses, and which may be twisted and folded to reduce the overall size of the assembly to facilitate convenient storage and use.

2. Description of the Prior Art

Collapsible objects have recently become popular with both adults and children. Examples of such collapsible objects are shown and described in U.S. Pat. Nos. 5,038,812 (Norman), 5,467,794 (Zheng) and 5,560,385 (Zheng) in the form of collapsible structures. These structures may be twisted and folded to reduce the overall size of the structures to facilitate convenient storage and use. As such, these structures are being enjoyed by many people in many different applications.

Another example of a collapsible object is a beach blanket as illustrated in U.S. Pat. No. 4,951,333 (Kaiser et al.). The beach blanket has a large springy hoop that is retained inside a blanket. The hoop is inserted into the blanket via a slit provided in an edge of the blanket. The beach blanket can be twisted and folded into a reduced configuration.

SUMMARY OF THE DISCLOSURE

It is an object of the present invention to provide a blanket or mat assembly that can be folded and collapsed into a smaller configuration for convenient storage and transportation.

It is another object of the present invention to provide a blanket or mat assembly that offers multiple uses.

It is yet another object of the present invention to provide a blanket or mat assembly whose components can be separated for different uses.

It is a further object of the present invention to provide a blanket or mat assembly that provides a panel that can be used as a mat.

It is yet a further object of the present invention to provide a blanket or mat assembly that provides a covering that can be used as a conventional blanket.

It is yet a further object of the present invention to provide a blanket or mat assembly that allows the user to conveniently replace or substitute the covering independent of the panel.

It is yet a further object of the present invention to provide a blanket or mat assembly that provides a sufficiently well-defined configuration that is not changed during use as either a blanket or a mat.

It is yet a further object of the present invention to provide a blanket or mat assembly that can be folded more quickly than a conventional blanket or mat.

In order to accomplish the objects of the present invention, the blanket or mat assembly according to the present invention includes a panel having a foldable frame member that has a folded and an unfolded orientation, and a sheet material substantially covering the frame member when the frame member is in the unfolded orientation, with the sheet material assuming the unfolded orientation of its associated frame member. The assembly further includes a covering having a top portion, a peripheral edge, an opening defined by the peripheral edge, and an interior, with the panel retained inside the interior and accessing the interior of the covering via the opening. The covering assumes the configuration of the panel when the panel is retained inside the interior of the covering. The covering and the panel can be twisted and folded to the folded orientation of the frame member to reduce the overall size of the covering and the panel.

According to one embodiment of the present invention, the dimension of the opening is smaller than a largest dimension of the frame member in its unfolded orientation when the panel is retained inside the interior of the covering. The covering can include an everted portion that is contiguous with the top portion and couples the peripheral edge. A sleeve extends along the peripheral edge for retaining an elastic band that reduces the dimension of the opening. As an alternative, a strap may be retained inside the sleeve, the strap having opposing ends that can be tied to reduce the dimension of the opening, or loosened to increase the dimension of the opening.

According to another embodiment of the present invention, a plurality of attachment devices can be provided in spaced apart manner adjacent the peripheral edge to secure the panel to the covering. The covering can have a plurality of extensions spaced-apart along the peripheral edge, with each extension having an attachment device provided thereon.

The collapsible assemblies according to the present invention is convenient for use since they can be easily and quickly folded and collapsed into a smaller size for transportation and storage. In addition, the covering of the assemblies can be removed from the panel to allow cleaning of the covering, or to substitute another covering having a different pattern and/or color design. The panel can be used as a mat separate from the covering, which can be used as a conventional blanket.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
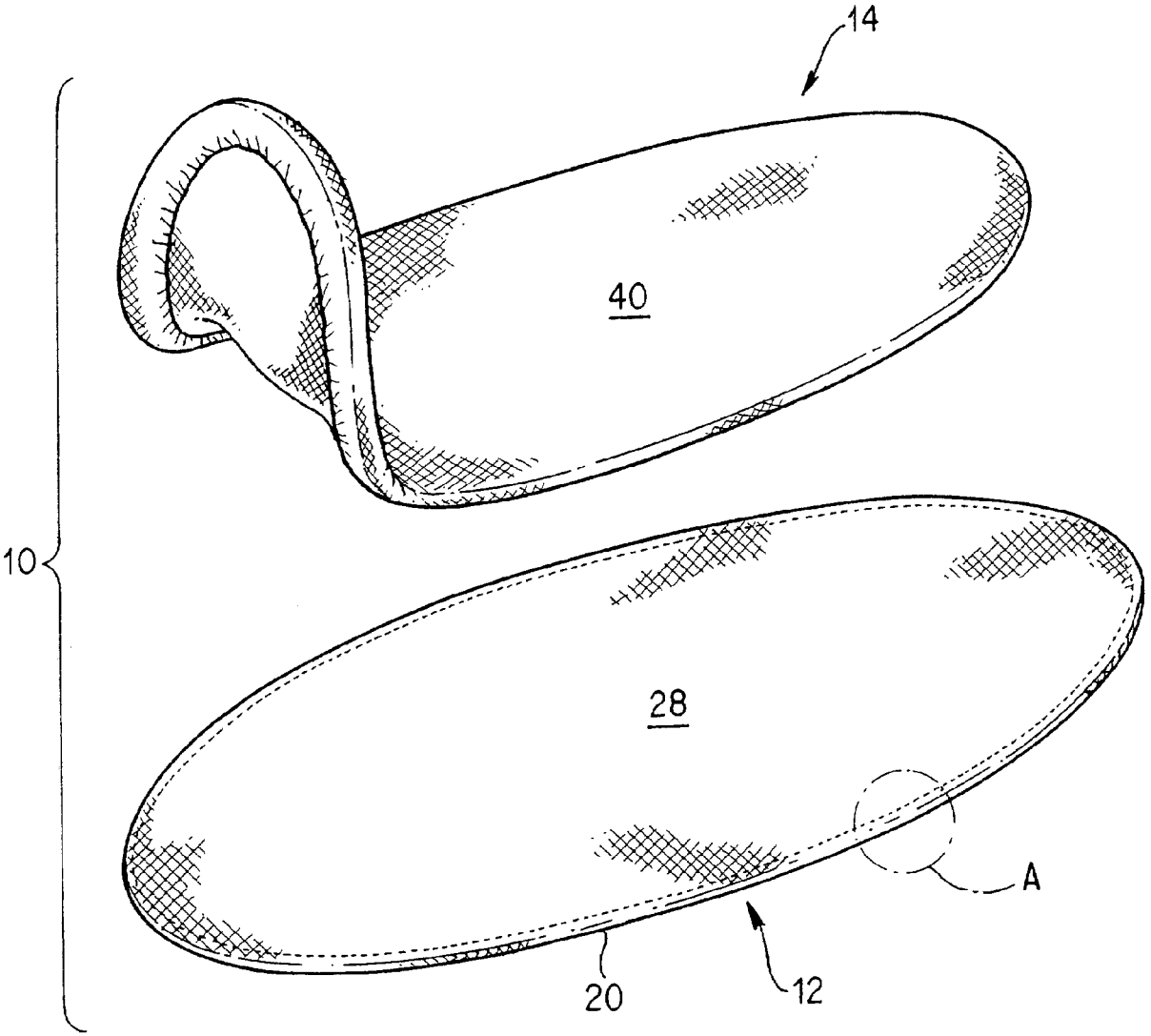
FIG. 1 is an exploded perspective view of an assembly according to a first embodiment of the present invention shown in use in its expanded configuration.
Figure 2:
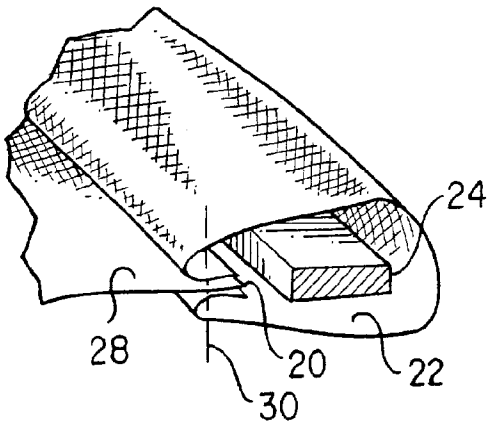
FIG. 2 is a partial cut-away view of the section A of the panel of FIG. 1 illustrating a frame member retained within a sleeve.

Referring to FIG. 1, the present invention provides a blanket or mat assembly 10 that has a panel piece 12 and a fabric covering 14. The panel piece 12 provides a base or support about which the fabric covering 14 may be wrapped. The panel piece 12 can assume any configuration, such as circular or oval (as shown), or rectangular, square, trapezoidal, or irregular. Referring also to FIG. 2, the panel piece 12 has an outer side or peripheral edge 20 that extends all the way around the panel piece 20. A continuous frame retaining sleeve 22 is provided along and traverses the side edge 20 of the panel piece 12. A continuous frame member 24 is retained or held within the frame retaining sleeve 22 to support the panel piece 12.

The continuous frame member 24 may be provided as one continuous loop, or may be a strip of material connected at both ends to form a continuous loop. The continuous frame member 24 is preferably formed of flexible coilable steel, although other materials such as plastics may also be used. The frame member 24 should be made of a material which is relatively strong and yet is flexible to a sufficient degree to allow it to be coiled. Thus, the frame member 24 is capable of assuming two positions, an open or expanded position such as shown in FIG. 1, or a folded position (see FIG. 5D) in which the frame member is collapsed into a size which is much smaller than its open position. The frame member 24 may be merely retained within the frame retaining sleeve 22 without being connected thereto. Alternatively, the frame retaining sleeve 22 may be mechanically fastened, stitched, fused, or glued to the frame member 24 to retain the frame member 24 in position.

Sheet material 28 extends across the panel piece 12, and is held taut by the frame member 24 when in its open position. The term "sheet material" is to be given its broadest meaning and should be made from strong, flexible yet lightweight materials and may include woven fabrics, sheet fabrics, meshed fabrics or even films. The sheet material 28 should be water-resistant and durable to withstand the wear and tear associated with extended use in connection with a plurality of different fabric coverings 14, and rough treatment by adults and children, especially when used as a mat as described below.

As illustrated best in FIG. 2, the frame retaining sleeve 22 may attached to the sheet material 28 along the side edge 20. Specifically, the sheet material 28 can be attached to the frame retaining sleeve 22 by a stitching 30 that extends along the side edge 20. The stitching 30 can also operate to enclose the frame retaining sleeve 22. Alternatively, the frame retaining sleeve 22 can be a part of or an extension of the sheet material 28, where the side edge of the sheet material 28 is wrapped around the frame member 24 to enclose the frame member 24, and then the stitching 30 applied to enclose the sleeve 22.

Figure 3:
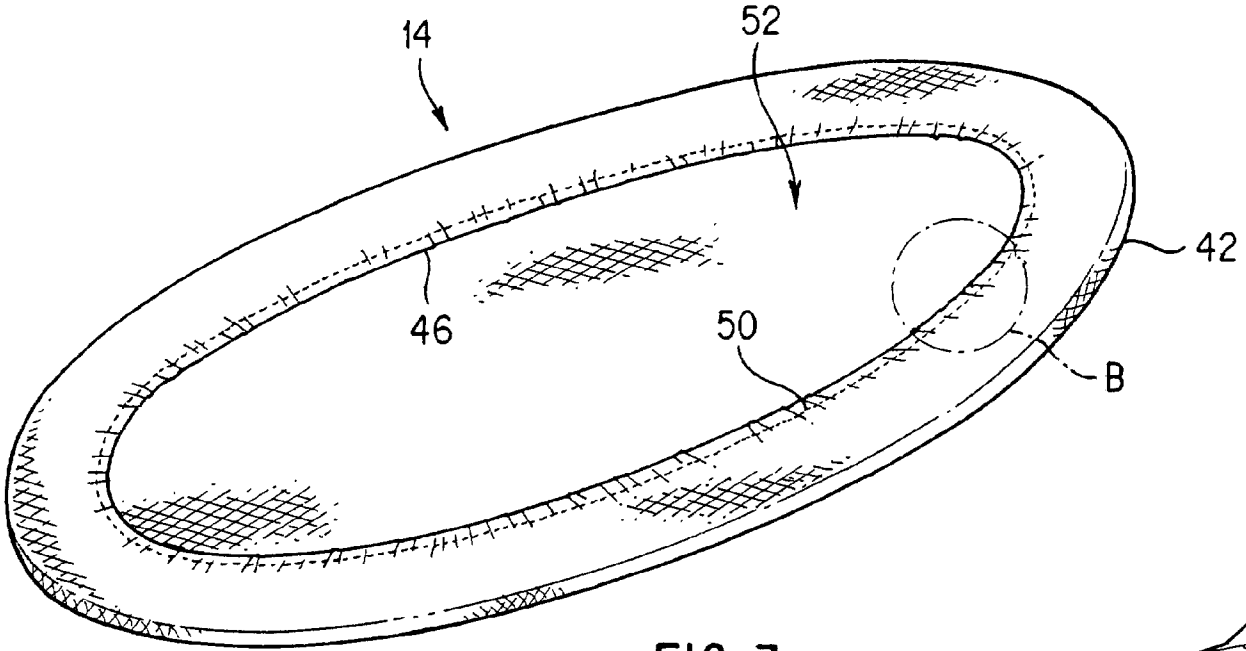
FIG. 3 is a perspective view of the fabric covering of FIG. 1 shown turned upside down with the bottom facing up.
Figure 4:
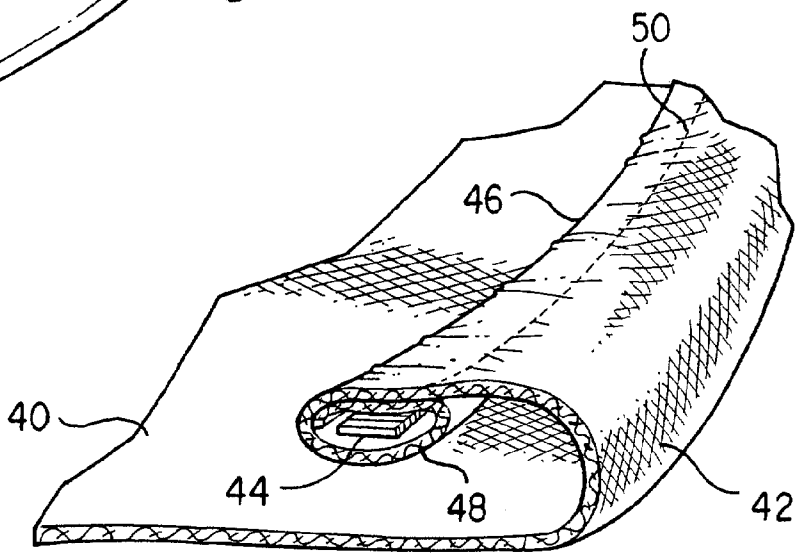
FIG. 4 is a sectional cut-away view of the section B of the fabric covering of FIG. 3.

The fabric covering 14 is best illustrated in FIGS. 1, 3 and 4. The fabric covering 14 has a fabric material which can be used as a blanket or the covering for a mat. As such, the fabric material can be cotton, wool, or any fabric or other material that is normally used for conventional blankets or mat covering. The fabric material assumes the same or similar general configuration as the panel piece 12. The fabric material has a top portion 40 and is everted inwardly at an everted portion 42. An elastic band 44 is retained inside an elastic retaining sleeve 48 that is provided and extends along the periphery of the side edge 46 of the fabric material. The elastic retaining sleeve 48 may be formed in the same manner as the frame retaining sleeve 22, such as by stitching the sleeve 48 to the fabric material, or by wrapping the fabric material over the elastic band 44 along the side edge 46 and then applying a stitching 50, as shown in FIG. 4.

As shown in FIG. 3, the provision of the elastic band 44 causes the side edge 46 to have an opening 52 that has a smaller diameter or dimension than the diameter or dimension of the fabric covering 14 at the everted portion 42. The diameter or dimension of the everted portion 42 is preferably slightly larger than the diameter or dimension of the panel piece 12 so as to allow the panel piece 12 to be fitted and securely retained in a taut fashion inside the fabric covering 14. In this regard, the smaller dimension of the opening 52 prevents the panel piece 12 from being removed from the interior of the fabric covering 14 unless the elastic band 44 is stretched to expand the opening 52.

Thus, the user can install the assembly 10 by stretching the elastic band 44 at the opening 52 and inserting the panel piece 12 through the opening 52 into the interior of the fabric covering 14. The coilable nature of the frame member 24 and the flexible nature of the sheet material 28 further facilitate this insertion since the panel piece 12 can be flexed and coiled to fit it through the smaller opening 52. When in use, the panel piece 12 is securely retained inside the fabric covering 14 with the outer side edge 20 of the panel piece 12 adjacent the everted portion 42 of the fabric covering 14. To remove the panel piece 12 from the fabric covering 14, the user merely stretches the elastic band 44 at the opening 52 to increase the size or dimension of the opening 52, and removes the panel piece 12 through the opening 52.

Figure 6:
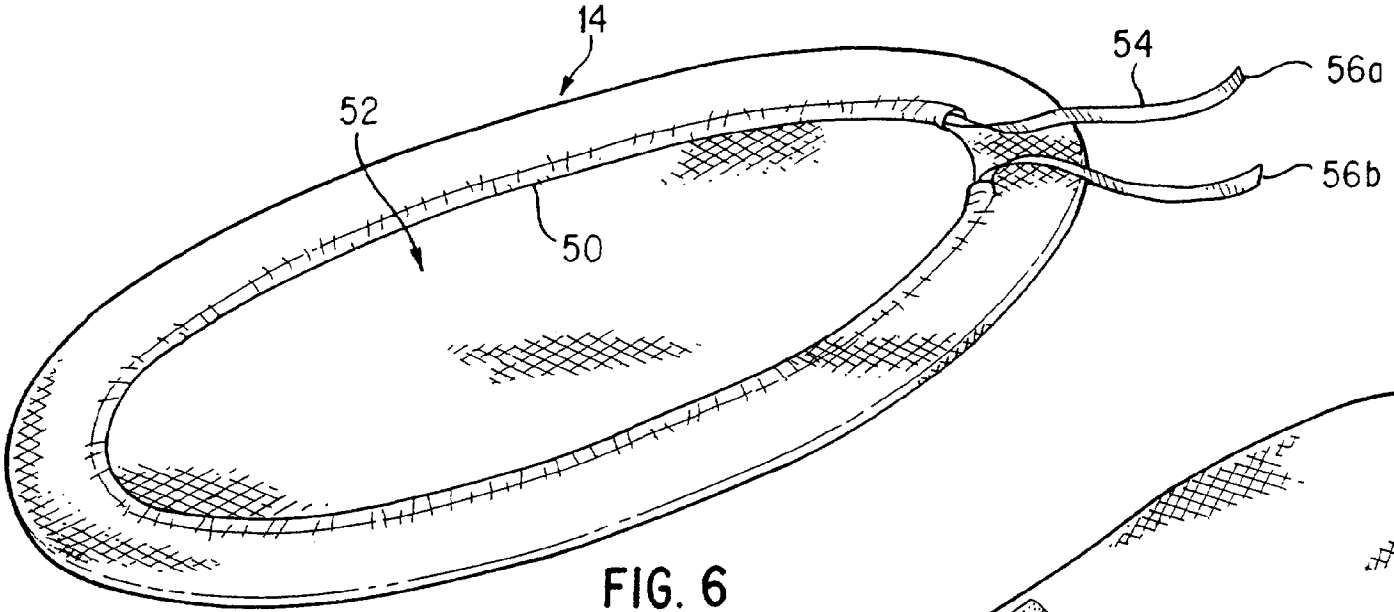
FIG. 6 is a perspective view of the fabric covering of FIG. 1 shown turned upside down with the bottom facing up, illustrating an alternative embodiment thereof.

As an alternative, the elastic band 44 can be replaced by a string or strap 54 that extends through the sleeve 48. See FIG. 6. The string 54 can be retained inside the retaining sleeve 48. The string 54 has opposing ends 56*a*, 56*b* that can be pulled tight to reduce the diameter or dimension of the opening 52, and the two ends 56*a*, 56*b* can be tied to maintain the opening 52 at the reduced diameter or dimension. Thus, the panel piece 12 can be inserted into the fabric covering 14 or removed therefrom by loosening the string or strap 54 to increase the diameter or dimension of the opening 52, and by tying the ends 56*a*, 56*b* to reduce the diameter or dimension of the opening 52.

Figure 5B:
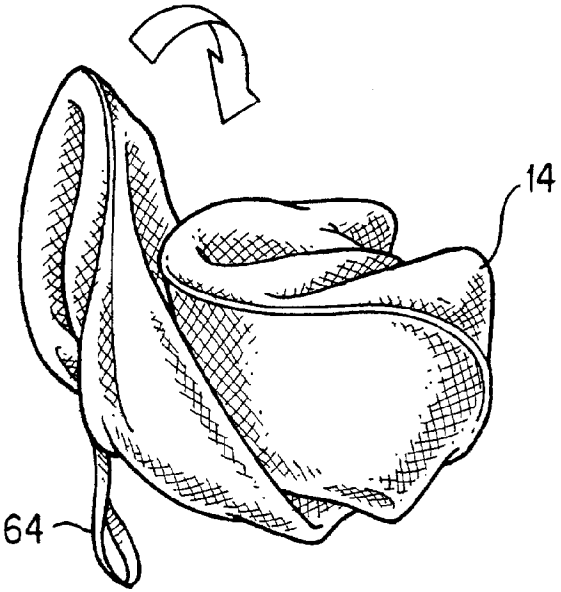
FIGS. 5A through 5F illustrate how the assembly of FIG. 1 may be twisted and folded for compact storage.
Figure 5C:
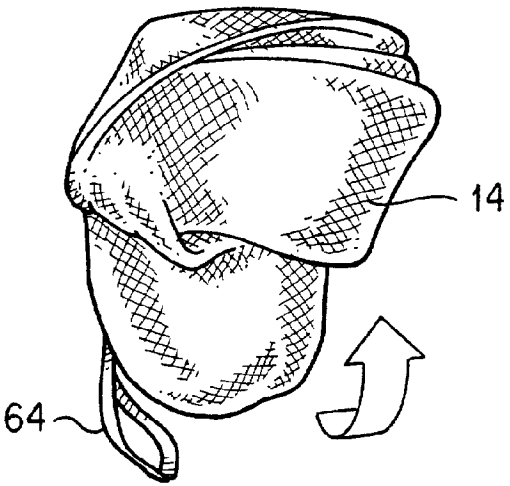
Figure 5A:
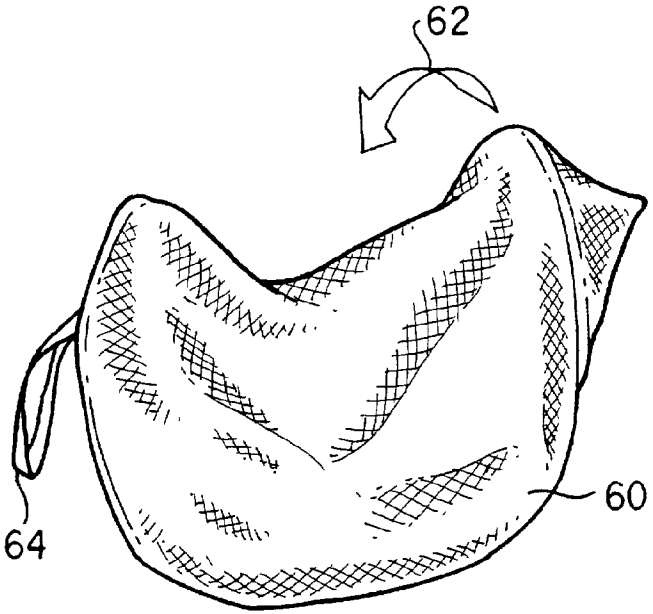
Figure 5E:
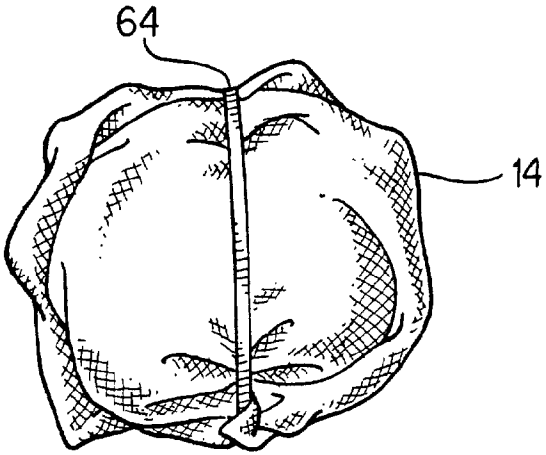
Figure 5F:
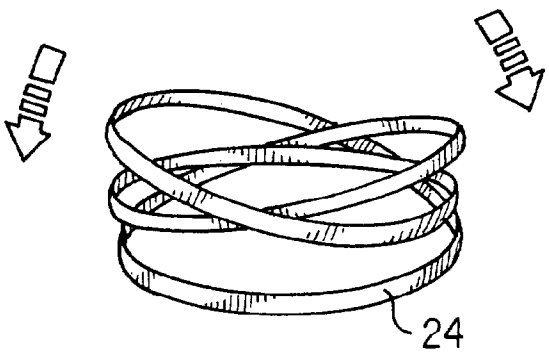
Figure 5D:
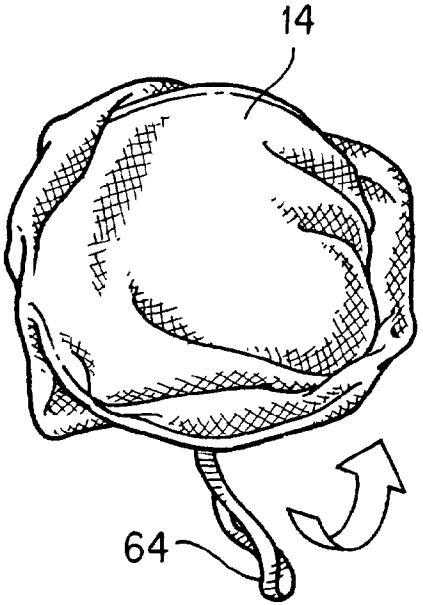

The assembly 10 can also be folded and collapsed into a compact configuration for storage, as illustrated in FIGS. 5A-5F. In folding and collapsing the assembly 10, it is possible to fold and collapse the entire assembly 10 (i.e., the panel piece 12 together with the fabric covering 14), or to first remove the fabric covering 14 (which can be folded separately as would a conventional blanket) and then fold and collapse the panel piece 12. In the first step illustrated in FIG. 5A, the opposite border 60 of the assembly 10 is folded in (see arrow 62) to collapse the frame member 24 with the panel piece 12. As shown in FIG. 5B, the second step is to continue the collapsing so that the initial size of the assembly 10 is reduced. FIG. 5C shows the third step with the frame member 24 and panel piece 12 collapsed on each other to provide for a small essentially compact configuration having a plurality of concentric frame members 24 and layers of the sheet material 28 so that the collapsed assembly 10 has a size which is a fraction of the size of the initial assembly 10, as shown in FIG. 5D.

In addition, a retaining member or strap 64 (shown in FIGS. 5A-5E only) may be attached to either the side edge 20 of the panel piece 12 or to the everted portion 42 of the fabric covering 14. As shown in FIGS. 5D and 5E, the strap 64 may be used to tie or hold the collapsed assembly 10 in the collapsed position. Alternatively, a bag (not shown) may be used to store the collapsed assembly 10.

FIG. 5F illustrates the closed loop of the frame member 24 in the collapsed position. The structure of each closed loop essentially consists of two sets of three loop rings intertwined to lie flat. In the collapsed position, the structure will have a significantly reduced diameter which makes it easy to store the collapsed assembly 10. This reduced size is especially convenient when the assembly 10 is to be used away from the home, such as during travel or camping or at the beach where the assembly 10 can be easily and conveniently packed, stored and transported.

Thus, the assembly 10 can be folded and stored very quickly using the steps illustrated in FIGS. 5A-5E. The folding of the blanket assembly 10 is assisted by the coilable nature of the frame member 24, and can be accomplished more quickly than the folding of a conventional blanket or mat, where the blanket or mat is folded after the edges are aligned, and then repeating the alignment of the edges and the further folding steps.

Figure 7:
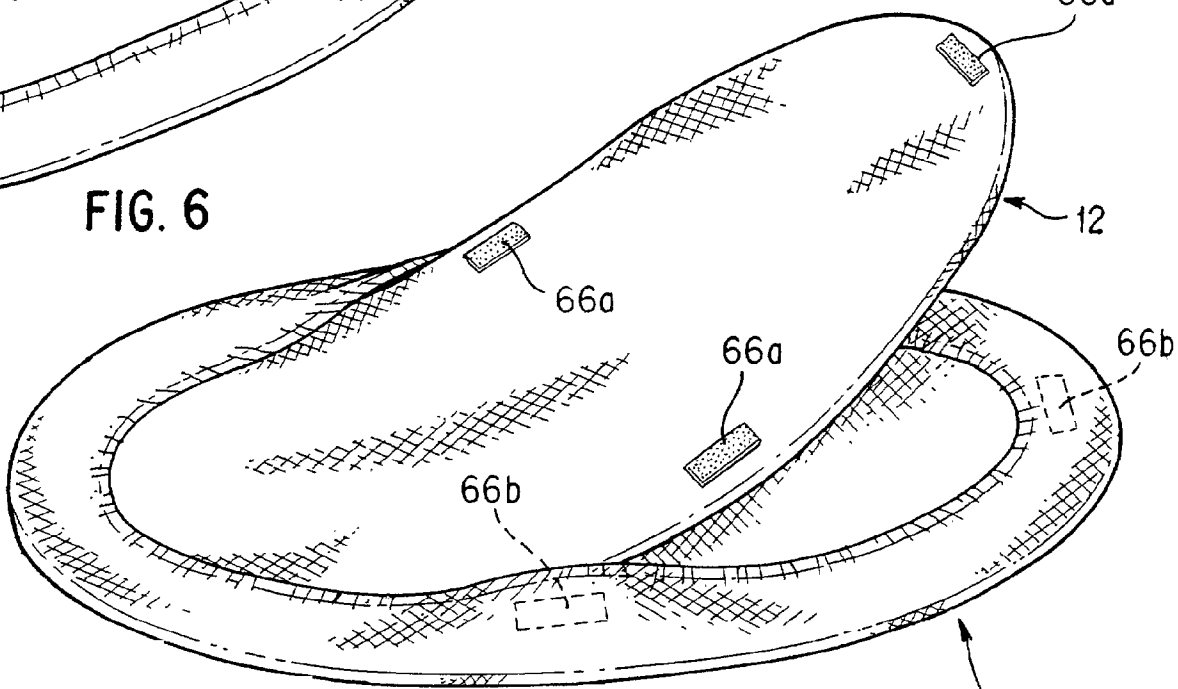
FIG. 7 is an exploded bottom perspective view of the assembly of FIGS. 1-4 illustrating a modification that can be made thereto.

FIG. 7 illustrates a modification that can be made to the assembly 10 of FIGS. 1-4. In particular, attachment devices can be provided to secure the fabric covering 14 inside the panel piece 12. These attachment devices can be provided in the form of opposing VELCRO™ pads 66*a*, 66*b*. Pads 66*b*are provided on the inside surface of the covering 14, and are therefore shown in phantom in FIG. 7. Alternatively, these attachment devices can be provided in the form of strings provided on either the panel piece 12 or the fabric covering 14 that can be attached to loops or other strings (not shown) in the corresponding fabric covering 14 or panel piece 12. Further alternatives for the attachment devices include hooks, straps or other such known attachment devices. In addition, depending on the type of attachment device(s) used, the attachment device(s) can even be provided on either the panel piece 12 or the fabric covering 14 only. FIG. 7 also shows the panel piece 12 partially extending through the opening 52 in the fabric covering 14 during the deployment process. It is possible to provide these attachment devices together with, or in lieu of, the elastic band 44 or the strap 54.

Figure 8:
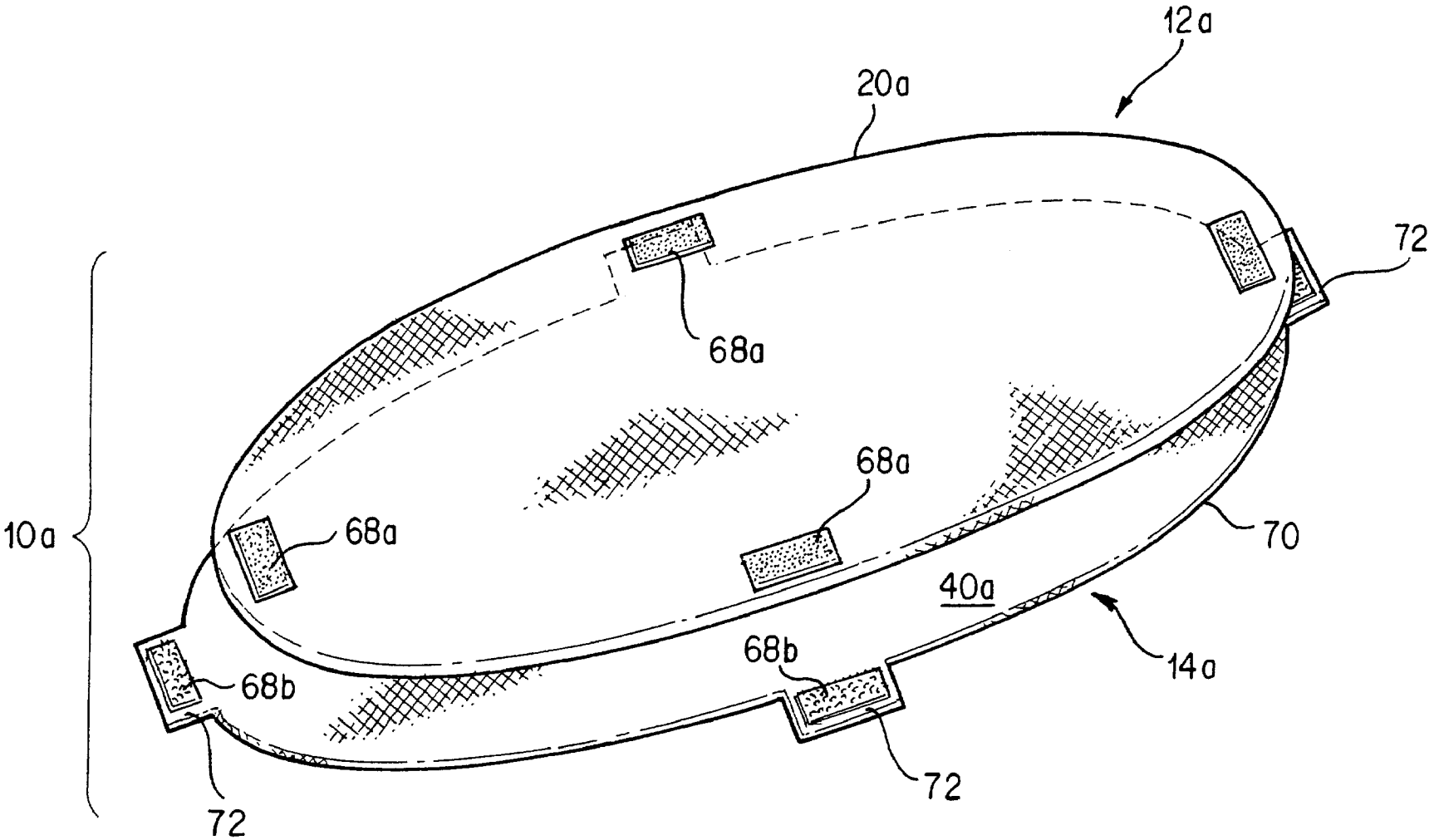
FIG. 8 is an exploded bottom perspective view of an assembly according to a second embodiment of the present invention shown in use in its expanded configuration.
Figure 9:
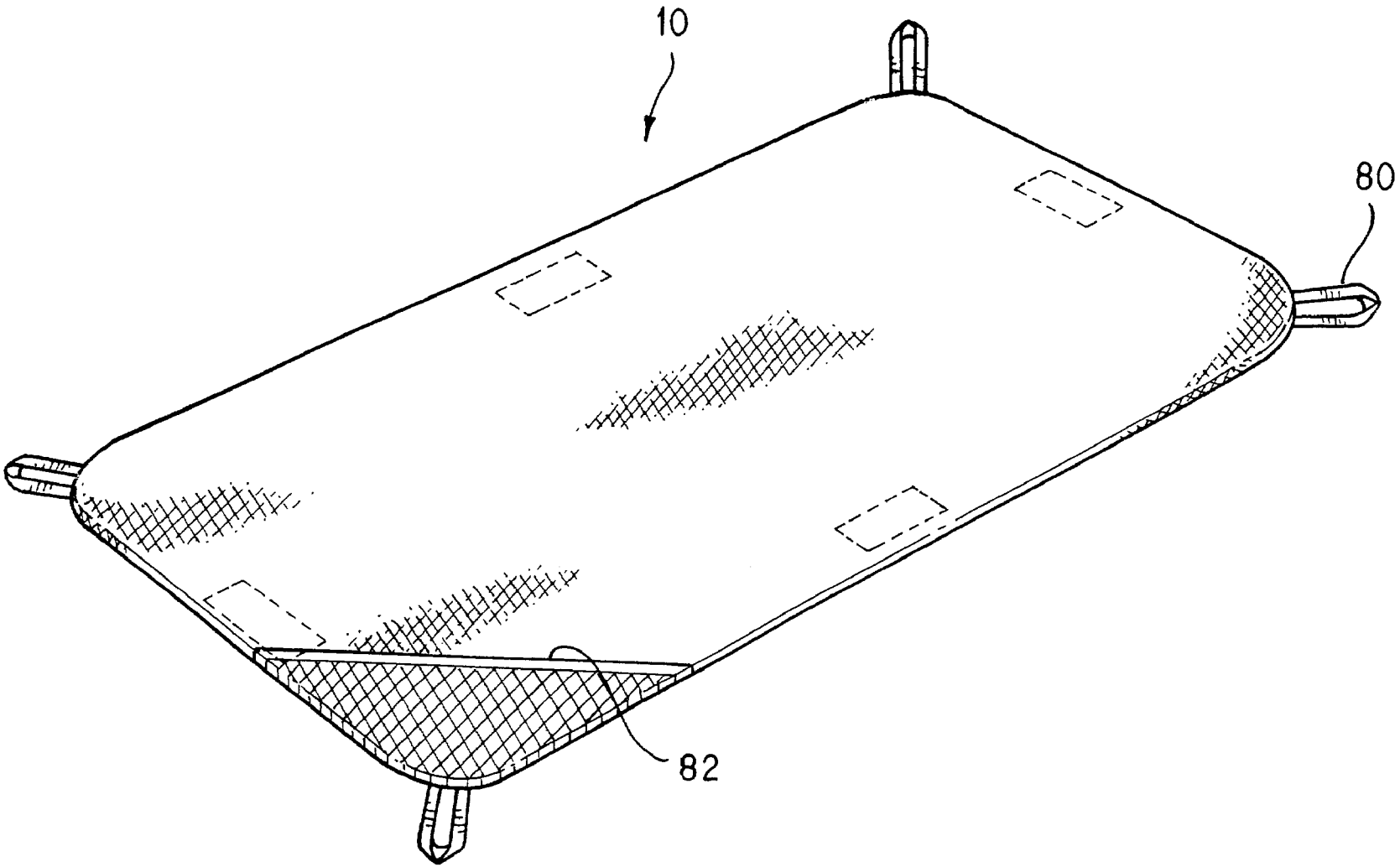
FIG. 9 is a perspective view of the assembly of the present invention shown in use as a mat.

FIG. 8 illustrates an assembly 10*a* according to an alternative embodiment of the present invention. Panel piece 12*a* is the same as the panel piece 12 shown in FIG. 7 and includes a plurality of attachment devices in the form of VELCRO™ pads 68*a*. These attachment devices are spaced apart adjacent the side edge 20*a* of the panel piece 12*a*. Fabric covering 14*a* is generally the same as the fabric covering 14 of blanket assembly 10, except that fabric covering 14*a* does not have an everted portion, an elastic retaining sleeve, or an elastic band. Instead, the fabric covering 14*a* has a top portion 40*a* and a peripheral side edge 70. A plurality of extensions 72 are provided in spaced-apart manner along the side edge 70. Each extension 72 is provided with an attachment device in the form of a VELCRO™ pad 68*b* that opposes and is adapted to attach to the corresponding VELCRO™ pad 68*a* on the panel piece 12*a*. Thus, to assemble the assembly 10*a*, the user merely places the top surface of the panel piece 12*a* against the bottom surface of the top portion 40*a* of the fabric piece 14*a*, and the extensions 72 are folded over about the side edge 70 of the panel piece 12*a* to cause the attachment devices (i.e., opposing VELCRO™ pads 68*a*, 68*b*) to be attached. The assembled assembly 10*a* provides the panel piece 12*a* securely retained within the grasp of the fabric covering 14*a*, and in particular, the extensions 72.

The assemblies 10 amd 10*a* can be used in many different ways. As a first example, the entire assembly 10, 10*a* can be used as a blanket and deployed and collapsed in the manner described above. As a second example, the entire assembly 10, 10*a* can be used as a mat and deployed and collapsed in the manner described above. When used as either a blanket or a mat, the assembly 10, 10*a* provides the benefit that the tautness of the frame member 24 and its panel piece 12, 12*a* provide a sufficiently well-defined configuration to the fabric covering 14, 14*a* so that creasing or wrinkling of the fabric covering 14, 14*a* is minimized when in use. When used as a mat, the assembly 10, 10*a*, loops 80 can be provided along the periphery (e.g., everted portion 42) for receiving stakes or other supports that can be used to secure the assembly 10, 10*a* to the ground. In addition, one or more pockets 82 can be sewn at one or more corners of the assembly 10, 10*a* for retaining miscellaneous objects, such as keys, purses and the like.

As a third example, the assemblies 10 and 10*a* can be separated for use, such as at the beach or during camping. In this regard, the panel piece 12, 12*a* can be removed from the fabric covering 14, 14*a* and used as a beach mat or sleeping mat during camping, with the fabric covering 14, 14*a* used as a conventional blanket. Thus, the blanket assemblies 10 and 10*a* provide two important components for a beach outing or camping trip, and provides these components together in one assembly so that the two components (mat and blanket) can be used separately or as a single assembly as desired by the user.

As a fourth example, the assemblies 10, 10*a* can be used as dividers for dividing a space into two separate spaces. For example, one assembly 10, 10*a* can be placed between two chairs to divide the space into two chair spaces.

The assemblies 10 and 10*a* according to the present invention may be provided in a variety of sizes and configurations to suit the needs and tastes of children and adults alike. The fabric covering 14, 14*a* can be easily removed for cleaning or to substitute a different fabric covering 14, 14*a* having a different pattern or color design, or to substitute a fabric covering 14, 14*a* having a different material providing different degrees of warmth. For example, in the summer, the user can use a cotton fabric covering 14, 14*a* that provides less warmth, while in the winter, the user can use a wool fabric covering 14, 14*a* that provides more warmth. In addition to the variety of applications described above, the assemblies 10, 10*a* provide the user with unlimited variety and flexibility in use, and allows the user to match the fabric covering 14, 14*a* with the decor of any room or furnishing. In addition, the durability of the panel pieces 12, 12*a* can be extended since they are covered by the fabric covering 14, 14*a* and can be used with a plurality of fabric coverings 14, 14*a* even after one or more fabric coverings 14, 14*a* have been worn out. The assemblies 10, 10*a* according to the present invention can be easily deployed and disassembled, and are easy to fold and collapse into a compact configuration for convenient storage or transportation.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible mat structure having a peripheral edge, comprising:

a frame member having a folded and an unfolded orientation;

an annular sleeve formed along the peripheral edge and retaining the frame member; and a planar covering removably securable to the sleeve;

wherein the covering is positioned in the same plane as the frame member when the covering is coupled to the sleeve.

2. The structure of claim 1, wherein the annular sleeve defines a central portion that is separate from the annular sleeve, and wherein the covering overlies the central portion.

3. The structure of claim 1, wherein the central portion is composed of no more than one layer.

4. The structure of claim 1, wherein the covering assumes the configuration of, and is about the same size as, the frame member when the frame member is in the unfolded orientation.

5. A collapsible mat structure having a peripheral edge, comprising:

a frame member having a folded and an unfolded orientation;

an annular sleeve formed along the peripheral edge and retaining the frame member; and a planar covering removably securable to the sleeve;

wherein the covering assumes the configuration of, and is about the same size as, the frame member when the frame member is in the unfolded orientation.

6. The structure of claim 5, wherein the annular sleeve defines a central portion that is separate from the annular sleeve, and wherein the covering overlies the central portion.

7. The structure of claim 5, wherein the central portion is composed of no more than one layer.

* * * * *